United States Patent [19]

Inzunza

[11] 4,195,501

[45] Apr. 1, 1980

[54] APPARATUS FOR TANNING SKINS

[76] Inventor: Luis G. G. Inzunza, Rio Petatlan 866, Culiacan, Sinaloa, Mexico

[21] Appl. No.: 942,641

[22] Filed: Sep. 15, 1978

[51] Int. Cl.[2] ..... C14C 1/00

[52] U.S. Cl. ..... 69/32

[58] Field of Search ..... 69/28, 29, 30, 31, 32

[56] References Cited

U.S. PATENT DOCUMENTS

| | | | |
|---|---|---|---|
| 538,911 | 5/1895 | Harrison | 69/29 |
| 659,077 | 10/1900 | Lester | 69/29 |
| 2,277,404 | 3/1942 | Kannell | 69/32 |

*Primary Examiner*—Patrick D. Lawson

*Attorney, Agent, or Firm*—Roylance, Abrams, Berdo & Farley

[57] ABSTRACT

An apparatus for tanning skins in a rapid and efficient manner includes a closed tanning tank and a plurality of storage tanks for storing the various liquids employed in tanning skins. The skins to be tanned are hung in the tanning tank. An air tight door is provided in the tanning tank for loading and unloading the skins. The tanning tank also has an inlet/outlet pipe for filling and emptying the tanning tank, which pipe is connected through a valve to an elevation pump. A respiration pipe having means for producing a gas which is chemically inert to tanning liquids is also provided on a tanning tank. Each of the storage tanks has an outlet pipe with a valve for controlling the flow of liquid therethrough which is connected to the elevation pump. Some of the storage tanks are airtight and have outgoing pipes connected to an outgoing pipe on the tanning tank to permit gases to flow between each of those storage tanks and the tanning tank. Other devices which may be operably coupled to the apparatus include an internal stirring system, an internal heating system and a dissolution tank. Also, a plurality of tanning tanks may be provided.

26 Claims, 17 Drawing Figures

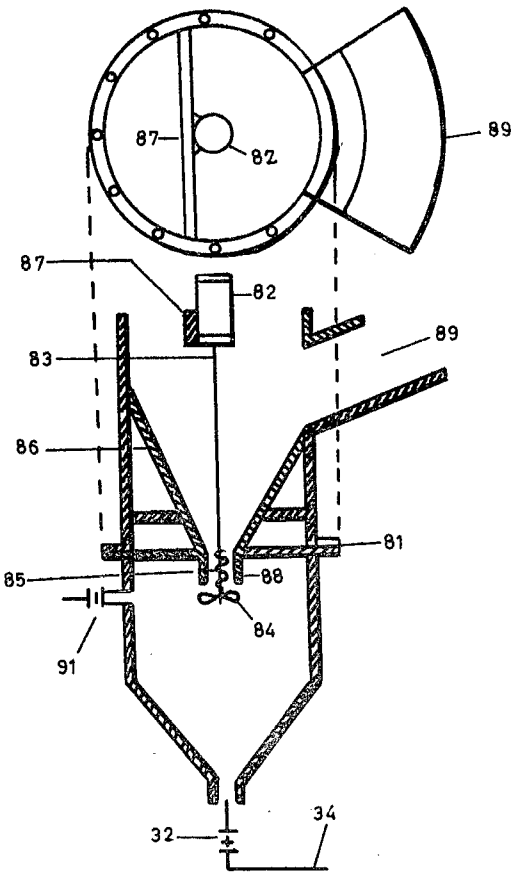
FIG. 12
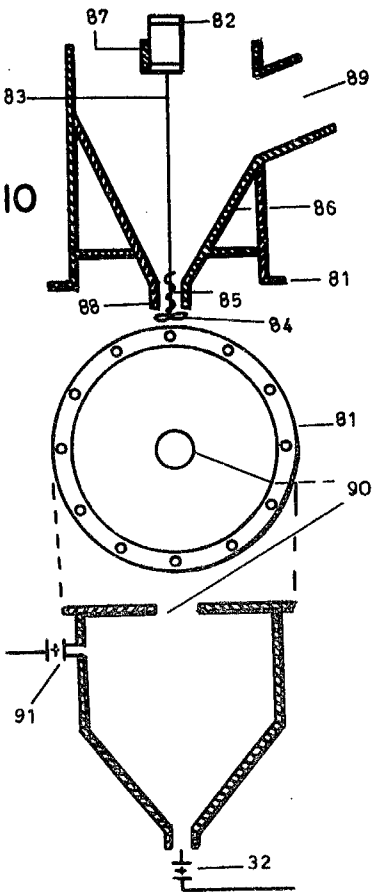
FIG. 10
FIG. 11
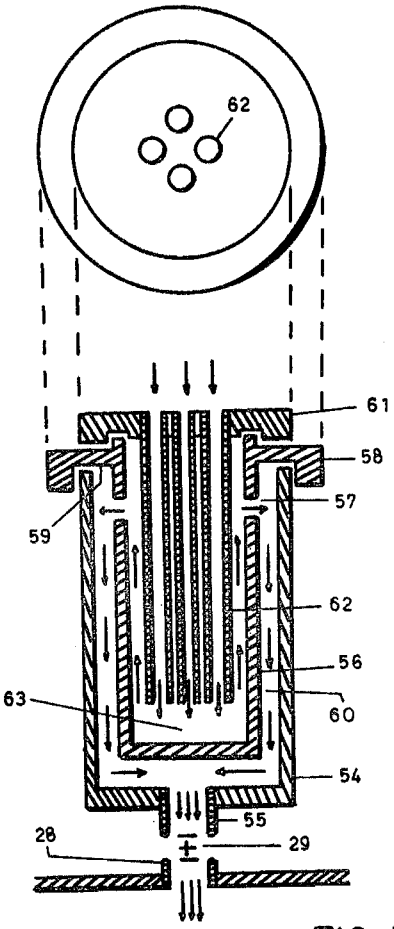
FIG. 13

APPARATUS FOR TANNING SKINS

This unit is an apparatus, a special installation for tanning heavy cow skins in a fast economic manner, for the manufacturing of leather soles.

Tanning in this unit has, in comparison with traditional tanning methods in our country, the following advantages: economy of time, materials and labor, with the additional advantage of a better yield and a better appearance of the finished leather.

I. ECONOMY IN TIME.—Tanning is carried out in a period of no more than two or three days, according to the skin thickness. As a consequence of this rapidity in tanning, the investment on skins subject to the manufacturing process is considerably reduced since the tanning "chain" is considerably shortened. The volume of tanning liquids to keep in use is highly reduced, all of this in comparison with the skin tanning method for soles most used in our country, which is the combined tanning in suspension piles and drums or fulling mills, that is, the so called "counterstream" tanning.

II. ECONOMY OF MATERIALS.—Economy in this aspect is very important. To begin with, it allows the recovery of the loosening and cleansing liquids, which may be used again with a mere reinforcement of materials. However, the most important part in this aspect is the economy of tanning liquids: accoring to some researchers, the losses of tanning materials that take place in a tannery are of the order of 25% of all the tanning material used, said percentage being subject to increases in warm climates; this is due to the channeling (drainage) of liquors; to the oxide-reduction reactions caused by the oxygen in the air, and to the fermentation and bacterian actions of different sorts. All of this would cause the degradation of the tanning material, transforming it into non-tanning material and precipitating it under the form of "sludge."

Tanning in the unit completely eliminates the causes for the aforementioned losses; on one side, since it is a closed system which works in complete absence of air, there is no oxidation. For the same reason, anti-bacterian control is perfect, it being possible to use bactericides in the required measures and amounts withou danger for anyone. Operators, during the discharge, handle skins that have already been washed and drained.

Losses due to drainage or channelings can be reduced almost to zero, as shall be seen later.

III. ECONOMY OF LABOR.—Tanning in this unit simplifies considerably all the operations performed in an ordinary Tannery. The unit receives the skins after the alkaline stream works. The unit is loaded with these skins and, once in there, they are loosened and softened; if so desired, they may be tarnished with some special material, and then the tanning, from beginning to end, that is, it performs the works that are equivalent to the softening drums, the suspension piles and the tanning drums. Furthermore, the skins can also be dephlegmated and left to drain off, so that they come out without liquid dripping, ready to press out and for the works of bleaching and finishing.

All these operations are carried out successively, one after the other, without any movement of the skins. The only works that require labor are the loading and unloading of the tanning tank and the reinforcement of liquors, which is carried out in this unit more rapidly, efffectively and with the minimum of labor.

In this unit skins are never moved while the tanning process is going on; it is the liquids that move. This is a basic difference with respect to all the known tanning methods.

IV. BETTER WEIGHT YIELD.—This is very important when skins are sold by weight. Experimental tests carried out in a pilot plant have shown a high weight yield in natural skin. This may be due to the fact that in the unit the operation is conducted at high temperatures in the tanning work, of up to 40°-42° C. in the final tanning stages. A more complete saturation of the skin fiber by the tannin is achieved thereby, and a skin with very saturated cut, heavier and water-resistant is obtained.

The leather obtained in this unit has a better "look," since sandpapered flower and the foldings that are produced in the drums are eliminated due to the fact that there are no frictional movements among the skins or against the drum walls.

The most used sole tanning method in our country is the one called "counter-stream." In this method, the skins, after the stream works, are loosened and softened in drums. Thereafter, the skins are passed to a series of suspension piles, the number of which varies from one tannery to another. There, the skins are treated for tanning, first in piles with spent liquors and thereafter, as the tanning progresses, the skins are put in troughs with more and more concentrated liquors. After the last suspension trough, the skins are taken out and the tanning process is completed in drums, treating them with highly concentrated solutions. Thereafter, they are unloaded from the drums and they are dephlegmated in troughs or in drums, after which they are unloaded and piled up. All of this implies considerable time and labor, as is well known, and it also involves a larger number of skins in the process and a considerable volume of tanning solutions.

Before ending this chapter, it should be mentioned that there exists a fast tanning method which, according to the information obtained, is widely used, mainly in some countries of Europe. We are referring to the so called "dry" tanning. In this process, the softening—conditioning—pre-tanning to be performed, as well as the tanning itself is carried out in drums, in "dry," that is, without a bath. The skins as tripe, alkaline, are introduced in drums and, once in there, the powders are added, that is, the softening and conditioning salts; all of this without water. After a certain number of hours of rotation, when the operation is considered as completed, the skins are dumped on the floor to get rid of the liquid formed due to the dehydration of the tripe. Thereafter, the skins are loaded again in the tanning drums and the tanning substance is added in the form of powder, without water. The addition of the tanning substance is carried out by lots, while the drum is turning around until the skins are "passed," which takes around 24 hours according to the information we have; the whole process may last one or two days. With this process a loss of tanning substance is produced which is not negligible, since during the tanning a new dehydration of the skin is produced which at the end leaves in the drum a certain amount of liquor which, together with that formed in the dephlegmation constitutes a certain amount of liquor that is economically relevant, since it must be thrown down the drain. With this and with the high cost of the products to take the lime off and the conditioning products, that must necessarily be used because they are products which are especifically developed for the purpose, an increase in costs is produced instead of a decrease of same.

Furthermore, the skins suffer certain deleterious effects due to the excessive dry beating, sandpapered flower, foldings, etc., and the different components of a skin cannot be tanned together, as is the case with croups, the front parts, the bellies; one is forced to tan only croups, fronts or bellies, which is another disadvantage.

Tanning in this unit does not present any of these disadvantages: the same traditional products to take lime off and to soften can be used in the purge. The tanning substance is handled in a very rational manner, without any waste, and last, the different components of a skin can be tanned together without any problem and without deleterious effects on the skins, as is the case with "dry" tanning drums.

Making a comparison between the methods or processes to tan skins for sole known in the art, that is, the "counter-current" or "upstream" tanning process and the "dry" tanning process and tanning in our unit, we find the following advantages and novel features in the latter:

ADVANTAGES OF THE PRESENT INVENTION (a) It substitutes completely and with great advantage the suspension troughs and the tanning drums in a Tannery. The unit contains all the necessary elements to carry out, with the exception of the stream and the finishing steps, all the operations that are performed in a Tannery that works with suspension troughs and tanning drums, such as: taking lime off and purging, the whole tanning process with its change sequence, reinforcement of liquors, that cleaning or filtering of same and finally the dephlegmation of skins. Although it employs the same counter stream tanning principle, it is essentially different because of its rapidity and economy and because instead of moving the skins as the tanning progresses, the liquids are moved by means of pumps. The skins always remain in the same place. In the unit work is performed in the same way as in the counter stream tanning process, with two or more liquors of increasing density, in order to facilitate the depletion and subsequently the renewal of the liquors. Although in the UNIT work can be performed with two liquors, one weak and one strong, the use of three liquors has been selected due to its advantages and to facilitate their renewal: one of low density (weak), another of medium density and one more of high density. Thus, number one is used until its depletion and is set aside; number two takes its place; with a portion of liquor number three a new liquor is prepared for number two and finally fresh liquor is prepared to replace the one that was spent. This represents a perfect rotation of the liquors, which in this case is highly facilitated due to the small amount of liquors in comparison with troughs.

(b) Another advantageous novel feature is the used of closed tanks of special design for tanning, and that of elevated tanks for liquor storage, and the way they are interconnected which is through double connections: one that connects them at their lower part, with a pump in the middle, and another that connects them at their upper part, in such a way that when a liquid is pumped from an elevated tank to an empty tank located at a lower level or viceversa, the liquid displaces the gaseous content from the latter to the former.

With this device, since the skins as tripe are loaded for tanning, upon introducing the bath to take lime off, same expels air from inside the tanning tank, and from then on until the skins are unloaded, tanned and washed, they have no further contact with air, and this is so for skins as well as for liquors, even while changes take place. This makes possible to maintain a clearer color in the liquors, as if they had been just prepared. The skin obtained has also a clearer color, which is an additional advantage.

(c) Another novel feature of the system is the simultaneous stirring and self-cleaning thereof. This makes it possible to keep the liquors free of solids in suspension, which constitutes a double advantage, since it speeds up tanning and economizes labor. In troughs, liquors are cleaned up by decantation, with more labor and tanning substance requirements.

(d) Due to the fact that the tanning tanks are tightly sealed, as well as the storage tanks, tanning at high temperatures without danger can be considered as another advantage for an operation of this kind. Tanning in the unit can be started at a temperature between 34° and 35° C., at which it generally, for instance in drums, it has to be stopped, since the rotation of the drum creates heat which makes it necessary to stop same in order to regulate the temperature; this means that the tanning process must be interrupted in its normal course.

Heat in the unit is regulated at will with great accuracy, turning a nuisance into an advantage, for it is well known that at high temperatures, particularly during the last tanning stages, the affinity between tannins and skin proteins is increased. This would represent a better weight yield and a better saturation of the skin fiber.

Several years ago, the tanning system in a HOT TROUGH was presented as a novelty, as an "advancement." As far as I know, it apparently has had no acceptance in our country, probably due to the important problems oxidation involves.

(e) Another and last novelty and advantage is the device for and the manner of carying out the "reinforcement" of liquors. This operation is caried out in the unit through a "dissolution tank" in a fast, effective and confortable way, and with a minnimum of labor, since it is not necessary, as in the case of troughs, to take the skins out aforehand.

Referring to the drawings which form a part of this original disclosure:

FIGS. 10–12 illustrate various views of the dissolution tank;

FIG. 13 is a plan and vertical section view of the sulfur burner;

In FIG. No. 1 we have, in the first place, a tanning tank or chamber 1, which is the receptacle where the skins to be tanned are introduced. This tank 1 is provided on the outside with steel belts 2 the number of which varies according to the size of the tank. The upper part of these belts adopts the form of a structure with an arch shape 3 which is also made of steel. These arches support the weight of the skins, which are suspended on them through the tank "roof," as shall be seen later on. The tank dimensions, width and lenght, are variable according to the desired capacity. Height may be constant. No. 4 is a door.

Figure 16:
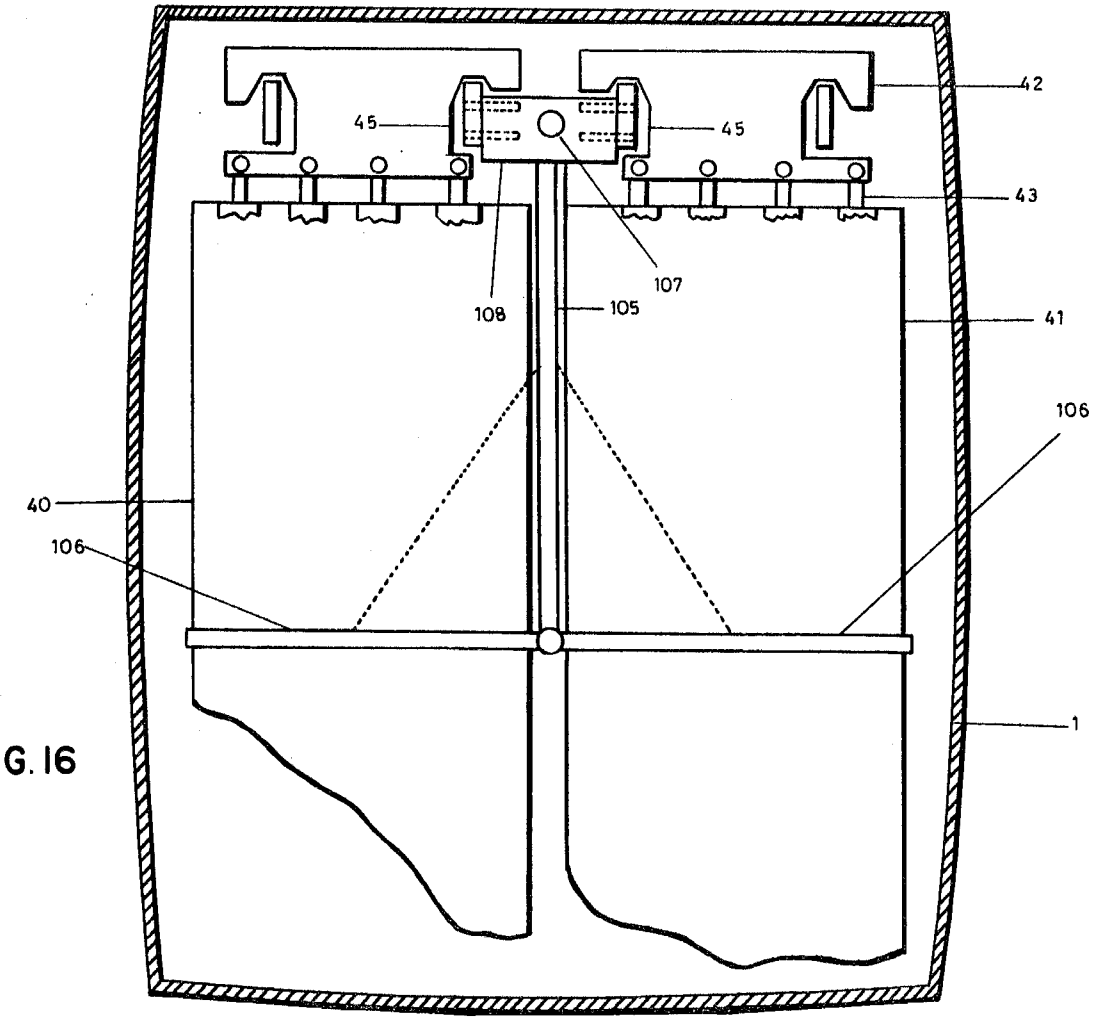
FIG. 16 is a perspective view of the frame for hanging skins in the tanning tank.

Tank 1 also has an internal stirring and liquid conditioning system which consists of the following: (a) a recirculating pump 5 and a filter 6 to keep in constant movement the different liquids inside by means of a procedure that consists of extracting same from the tank and re-injecting them therein, passing them before through the aforementioned filter, and (b) a device, FIG. No. 15, for the internal movement of the skins subject to tanning such device consisting of a motor-reductor 101 with an eccentric 102 conveniently placed on the outside, on the upper central portion of the tanning tank; the eccentric, by means of a connecting rod 103 transmits a swinging movement to the shaft (104); this shaft forms part, inside the tank, of a frame 105, one of the sides of which, the lower side, has a number of hinged cross-members 106, FIG. No. 17, so that they can be folded in, that is, placed vertically so that they are not in the way when loading and unloading the skins. In a horizontal position, these cross-members are placed among the skins suspended from the "roof," as shown in FIG. 16. These cross-members, with the swinging movement of the frame, the shaft of which 104 moves through the drill 107 of plate 108 mounted between the two rails 45, give the skins a pendular movement.

Figure 1:
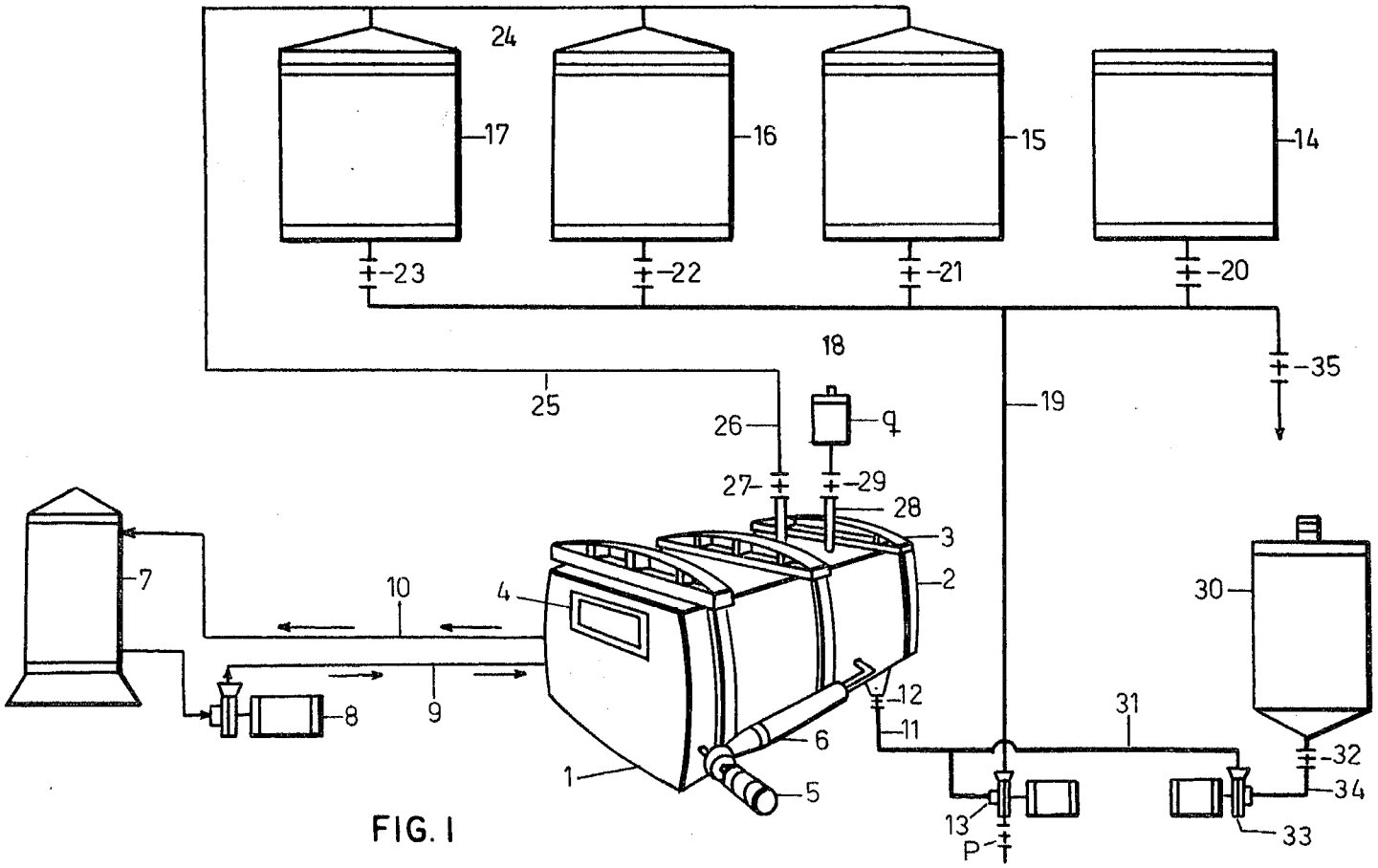
FIG. 1 is a graphic illustration of an apparatus for tanning skins according to one embodiment of the present invention.
Figure 8:
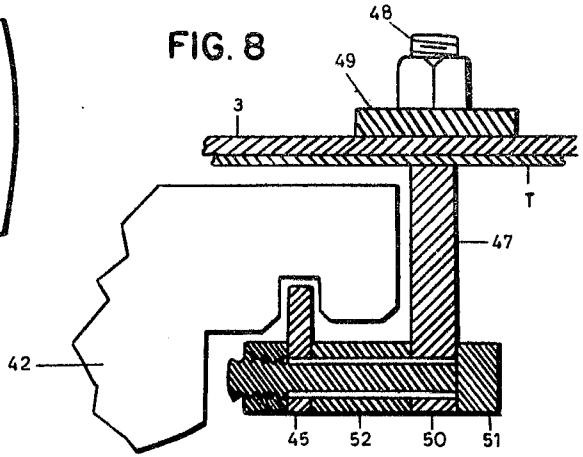
FIGS. 7 and 8 are cross sectional views of details of the structure for hanging skins in the tanning tank.
Figure 4:
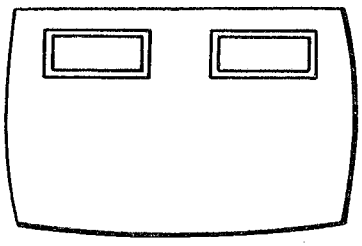
FIGS. 2–4 illustrate various views of the tanning tank of the present invention.
Figure 3:
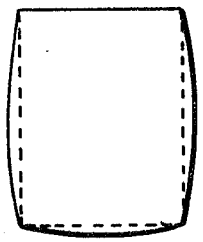

Tank 1 also has a heating system which operates by means of hot water or steam, which in FIG. 1 is only partially shown; to the left of the drawing we can see heater 7, pump 8 for recirculating hot water, pipe 9 through which hot water goes into tank 1, and pipe 10 through which cooled water comes back to heater 7.

On its lower part, tank 1 has an ingoing pipe 11 for liquids which also functions for outgoing liquids and which has a valve 12 for flow control. Pipe 11 is connected to the suction of a pump 13. This pump is located on a level that is lower than the "floor" or bottom of the tank 1.

On the upper part of the drawing of FIG. 1 four elevated tanks 14, 15, 16 and 17 are shown, which are located on a higher level than the tanning tank and which contain the different liquids that are used in the several operations or tanning stages. Said elevated tanks have on their lower part an output pipe each with its respective valve, marked with numbers 20, 21, 22 and 23, in the same order.

A pipeline 18 connects them among themselves, said pipeline being in turn connected through another pipeline 19 to the discharge of pump 13.

Connected in this way, any of the liquids contained in any of the elevated tanks can go down, by gravity, to tank 1; for example by opening valve 20 of tank 14 and valve 12 of tank 1, the liquid contained in said tank 14 goes down end fills tank 1, going into same through pump 13. Or opening valve 23 of tank 17 and valve 12 of tank 1, the liquid contained in said tank 17 shall go down to tank 1. In any case, pump 13 or elevation pump may return the liquids to the same elevated tank from which they came.

Of the four elevated tanks, one, number 14, has atmospheric communication on its upper part; the other three, numbers 15, 16 and 17 are tightly sealed, but they are intercommunicated and each of them has an output pipe on its upper part; a pipeline 24 communicates them among themselves, and said pipeline in turn is connected, through another pipeline 25, to a pipe 26 which starts at the upper part of tank 1. In this way, elevated tanks 15, 16 and 17 are intercommunicated and also connected to the tanning tank 1, the upper part of the former with the upper part of the latter; valve 27 of pipe 26 serves to interrupt said communication when so desired.

Tanning tank 1 has on its upper part a pipe 28 which we call "respiration pipe" and which serves to let air out or in when a liquid goes in or out of tank on its lower part. A valve 29 can close said atmospheric communication. On its upper portion, said respiration pipe has a sulphur burner "q" to produce $SO_2$, the description and operation of which shall be made later on.

On the right lower extreme of FIG. 1 is shown a tank 30 which we call the dissolution tank. It is of a smaller size than tank 1 and it is located at the same level. This tank 30 serves to dissolve and introduce to tank 1 the tanning extracts that are used for tanning and it has on its lower portion an output pipe 34 with a valve 32 for flow control. Both tanks, numbers 1 and 30, are communicated on their lower portion by means of a pipeline 33 placed in between and connected in the folowing manner: discharge of pump 33 is connected with the pipeline that comes from tank 1, and the suction of the pump with the lower output pipe of tank 30.

Connected in this way, said tanks 1 and 30, a liquid from tank 1 can pass by gravity to tank 30 by opening valves 12 and 32. The passage of liquid is through pump 33. Actuating the latter, the liquid shall return to tank 1.

Figure 2:
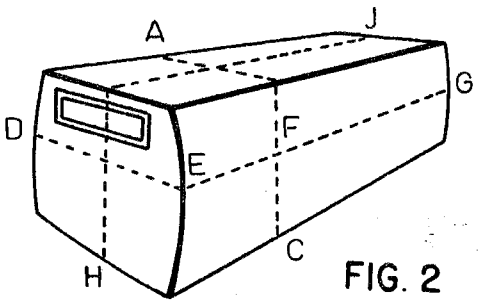

Although the tanning tank may have any shape, the one that has been adopted is that which accommodates the largest number of skins in the smallest space. This shape is that of a parallelepiped, FIG. 2, that is, an elongated tank with a rectangular ABFC cross-section, FIG. No. 3, although with its side walls and "floor" slightly arched. The upper wall or "roof" of the tank may be flat.

Door 4 of tank 1 is for loading and unloading the skins, it being possible to have more than one depending on the width of the tank. See FIG. No. 4.

In order to show some of the parts of the unit which cannot be seen on the drawing of FIG. No. 1, FIG. No. 5 shows the same drawing as a plan drawing. In this drawing, tank is shown in a plan and in cross-section following line DEFG of FIG. No. 2 in order to present the inside; we can see recirculating pump 5, suction 36 of pump 5, and filter 6 and the discharge of said pump, which is carried out inside the tank through pipe 37 which we call the distribution pipe. This pipe 37 has several outlets, or nozzles, throughout its lenghth in order to achieve a better and more uniform movement of all the liquid mass.

Figure 5:
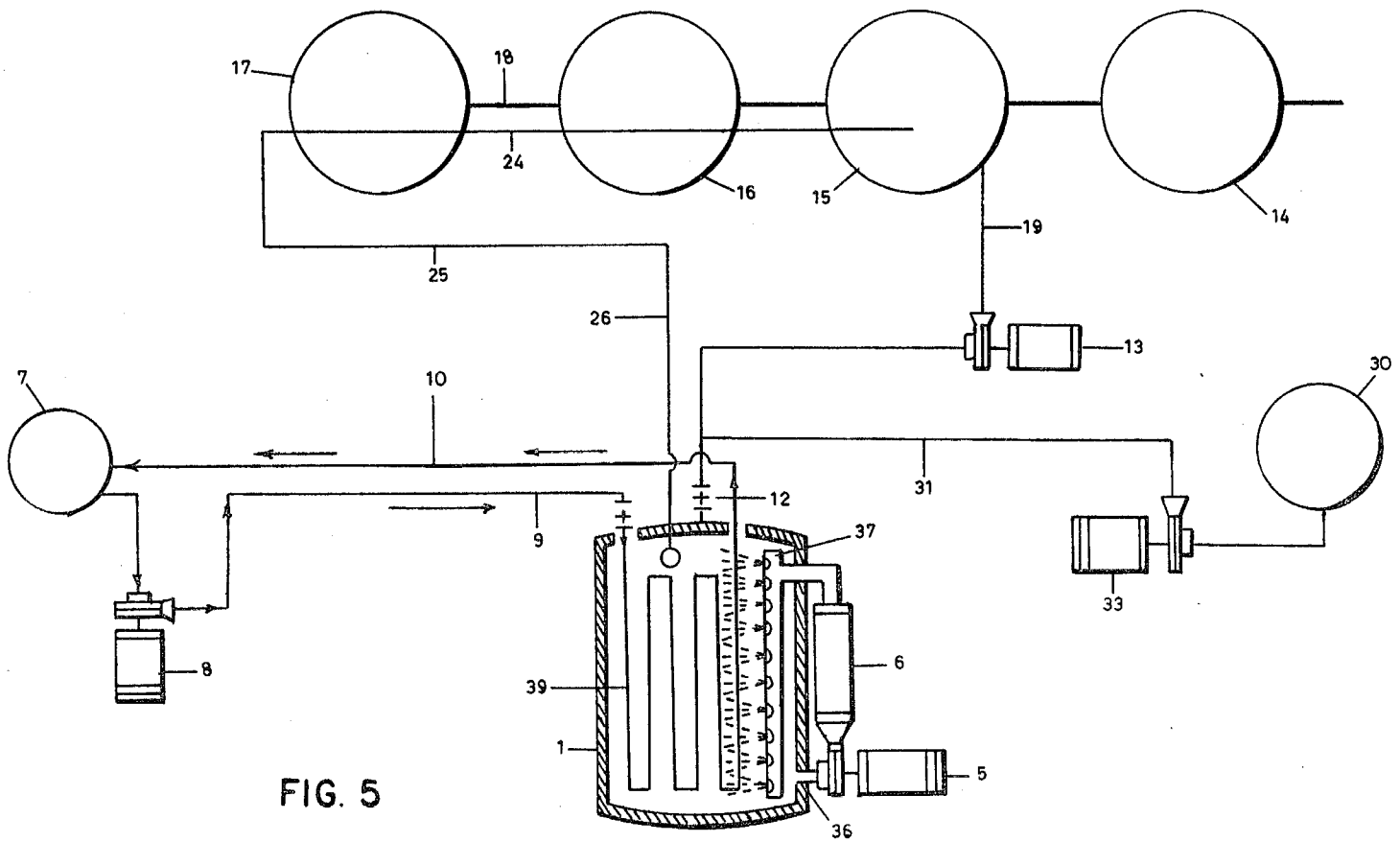
FIG. 5 is a plan view of the apparatus of FIG. 1, illustrated partially in cross section.

We also see a pipeline or coil 39 drawn schematically, as a part of the heating system of the unit. The other parts shown in FIG. 5 are already known and perfectly identifiable.

In order to show the inside of tank 1 and the way to hang or suspend the skins in same, let us look at FIG. Nos. 6 and 7. FIG. No. 6 is a vertical projection of a cross-section following line ABFC of FIG. No. 2. FIG. No. 7 is a part of a vertical projection of a longitudinal section following line HIJ of the same FIG. No. 2.

Figure 7:
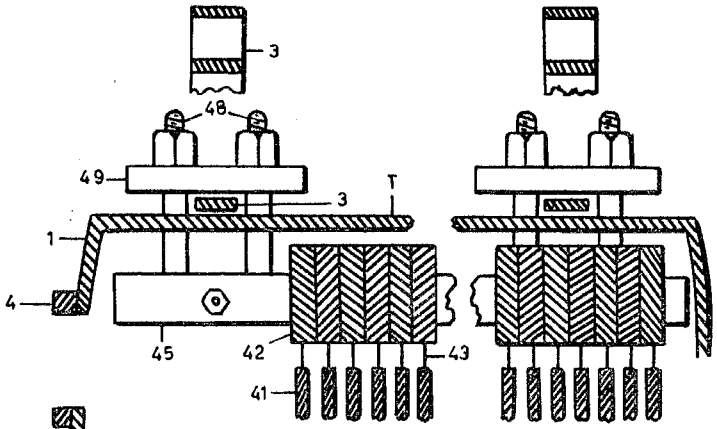
Figure 6:
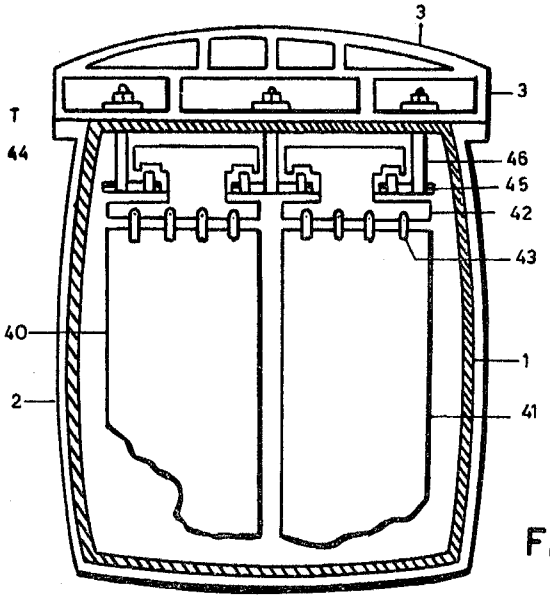
FIG. 6 is a cross sectional view of the tanning tank.

It is pertinent to make a statement here: although skins caan be introduced complete or cut in halves for the manufacture of soles, said cutting being made in any case to obtain the different components such as croups, etc., it is more practical and convenient, due to easier handling and better accommodation, and to make better use of the inside space, to put in the unit skins that have already been cut up, whether they are salted or as tripe, after taking away the meat or before, as is most convenient. In FIG. Nos. 6 and 7 we can see the inside of tank 1 with a front part of a skin and a croup of same, 40 and 41, suspended from special hangers 42 made of wood, by means of tongs 43. Hangers have two notches or guides 44 in order to lie on steel pieces which have the form of "rails" 45 which run throughout the length of the tank. These "rails" are in turn suspended, throughout the "roof" T of tank 1, from the lower portion of arch or belt 3 by means of special pieces 46, as shown in FIG. 7. In FIG. No. 8 some of these pieces 46 are shown. This FIG. No. 8 is a vertical projection of a longitudinal section of one of these pieces 46. They are formed by a metal plate or steel piece 47 with two screws 48 welded to the sides of one of its edges. With these two screws 48 and plates 49 with two holes a clamp is formed with which they are mounted on the lower part of arch 3, from the inside of tank 1 and through roof T of the tank.

The lower edge of plate 47 has a hole 50 through which a screw 51 holds rail 45 on bushing 52. The latter is a simple separator.

Skins or their parts are suspended as shown in FIG. Nos. 6 and 7 as close together as possible, taking care that they are not pressed too tightly among themselves. In actual practice, for thick skins, a distance of one inch from center to center of the skins has proved to be quite satisfactory. Thinner skins can be placed closer, with the use of thinner hangers, for said hangers serve as separators of the skins.

OPERATION OF THE TANNING UNIT

We shall hereinafter proceed to explain the operation of the tanning unit, referring for such purpose to FIG. No. 1.

Let us assume that we have tank 1 already loaded with the skins, as previously mentioned, and duly closed.

Elevated tank 14 contains the solution to take lime off already prepared, and the other elevated tanks have the following contents:

Tank No. 15 has liquor No. 1, weak, for example, Be. 4

Tank No. 16 with liquor No. 2, medium, for example Be. 8

Tank No. 17 with liquor NO. 3, strong, for example, Be. 12–14.

Let us proceed now with the first operation: taking the lime off and purging the skins.

We open valves 20 and 12 and 29 of the respiration pipe 28. The content of tank 24 goes down by gravity and through pump 13 fills up tank 1. The entrance of liquid is through the lower portion of the tank; the displacement of air contained in the tank is through pipe 28, which is the only way out for same since valve 27 is closed. Liquid is let in until it covers the skins, and thereafter valves 20 and 12 are closed. The stirring system of the tank, that is, the recirculating pump 5 and motor-reductor 101, for the internal movement of the skins, are actuated, and if there is a need to heat up the bath heater 7 is started up and its recirculating pump 8 is actuated as long as it is necessary to obtain the desired temperature.

The stirring movement may continue almost without interruption until the operation is considered completed.

Once the above is finished, valves 12 and 20 are opened and the liquid is displaced through pump 13, which pumps it up to its corresponding tank No. 14. This purging bath may be used for another batch of skins, with a small salt reinforcement. If such is not the case, it can be let out down the drain by opening valve 35.

Normally, upon drainage of the purging bath, an equal volume of air shall come in through the respiration pipe; if instead of air we let any other gas come in, which can be achieved by connecting this pipe 28 with a receptacle containing for example nitrogen, $CO_2$ or $SO_2$, or any gas that does not oxidate or react chamically with the tanning liquids, when the bath has been completely drained out tank 1 shall be filled up with the skins and with the gas that has been let in, but without air.

Once the bath to take lime off has been completely drained out, valve 29 of the respiration pipe 28 is closed up, as well as valve 20 of tank 14. On the lowest part of pump 13 there is a purging cock P through which the leakage of the tank and the liquids remaining in the pipe are let out. Said cock P is closed up.

Tanning as such is now begun: valve 21 of elevated tank 15 is opened; valve 12 is already opened. Valve 29 of the respiration pipe 28 should be closed, but instead we open valve 27 which communicates on the upper part with the upper tanks.

The content of tank 15, which is tanning liquid No. 1, comes down and goes into tank 1 on its lower part, pushing out any gases same may contain, which shall go out through their only possible exit, valve 27, and through pipes 26, 25 and 24 shall reach tank No. 15. An exchange of liquid-gaseous content takes place now between tanks 1 and 15; in the end, tank 1 has the liquid of tank 15 and tank 15 has the gaseous content of tank 1. It should be noted that in this movement there has been absolutely no contact with external air, either by the tanning liquid or by the skins.

Tanning liquor is let in to reach a level to cover only the skins. Valves 12 and 21 are closed up. The stirring system is actuated. In case heat is required, since tanning with this first liquor can be started safely at a temperature of 33°–35° C., heater 7 is started up as well as its pump 8 until the desired temperature is reached. The stirring system is kept in operation almost continuosly for approximately 24 hours.

Once such period has lapsed, tanning is continued with liquor No. 2. Liquor No. 1 is drained out first, sending it to tank 15, which is achieved by means of pump 13, previously opening the corresponding valves, that is, valves 12 and 21. This liquor 1, as a result of its return to its tank through the lower portion of same, displaces the gaseous content of said tank through its upper part, and said gaseous content returns through pipelines 24, 25 and 26 to tank 1. This new content exchange between tanks 1 and 15 takes place without any contact with outside air, and valve 21 is closed up.

We now make liquor No. 2 go down from tank 16 by opening valve 22.

Said liquor No. 2 fills up tank 1 and displaces and pushes its gaseous content upwards to tank 16, in an identical operation to the one that took place with the first liquor.

The stirring system and heater 7 with its pump 8 are actuated once more; in this second tanning stage, liquor No. 2 can be heated up to a temperature of 34°-36° C. without danger, according to experiments performed.

The stirring system should work another 24 hours almost uninterruptedly, or following time intervals.

Once said time has lapsed, liquor No. 2 is let out in order to continue tanning with liquor No. 3. Liquor No. 2 is first drained out by means of pump 13, opening valves 12 and 22. When said liquor goes up to its tank 16, it displaces the gaseous content thereof and sends it to tank 1, repeating again the same operation. Valve 22 is closed up and valve 23 is opened up in tank 17, and liquor No. 3 goes down, sending the gaseous content to tank 17. In all cases, the liquor should be let into tank 1 only in enough quantity to cover up the skins. Valves 23 and 12 are closed up. Tanning continues with liquor No. 3. The heater and the stirring system are actuated. This last liquor can also be heated as the other two to temperatures of 38°-40° C. and up to 42° C. towards the end, without any problem according to experience.

After 24 more hours the skins should be well tanned and the last tanning liquor, No. 3, can be let out. Opening up valves 23 and 12, this liquor is sent to its tank No. 17 through pump 13. Gas shall again return to tank 1. Valve 23 is closed up. Skins are left to drain in the tank and the remaining liquids are extracted through purging cock P of pump 13.

The last operation takes place now: washing or dephlegmation of the skins. We use as washing liquid liquor No. 1. This liquid is let down by opening valve 21; the gaseous content of tank 1 goes up to tank 15. Valve 21 is closed up.

Washing is carried out with the stirring pump 5. When washing is completed, liquor No. 1 is returned to its tank 15 enriched with the tanning liquor extracted in washing. In the end, tank No. 1 remains with the gases.

Skins are let to drain inside tank 1 enough time to stop leaking. Leakage is extracted through purging cock P. Tank 1 is ventilated for a while and skins are unloaded. Tank 1 and pipelines are washed with abundant water and the unit is ready to receive another batch of skins.

The gas to be used in this tanning unit should be an inert gas with respect to the tanning liquors used, that is, it should not react chemically with same, as is the case with oxygen. Convenient for the purpose are, for example, nitrogen, $CO_2$ and $SO_2$; the latter seems to be specially appropriate due to its chemical properties which are opposite to those of oxygen. Instead of oxidating, it reduces the tanning material and consequently it clarifies the liquors and skins instead of darkening same; it also possesses a certain bactericidal action which is highly beneficial.

Regardless of the gas that may be selected, since it has to be wasted with each batch of skins, an apparatus has been designed in order to obtain sulphur oxide at low cost which can adequately be adapted to the unit, or more precisely to the tanning tank. This apparatus is a burner which can use sulphur as fuel and which sends combustion gases into the tank instead of letting them out into the air. This burner is fixed to the respiration pipe 28 of tank 1 and it operates with the air drafts that are produced towards the inside of tank 1 when letting out the bath after purging, as previously explained when describing the operation of the tanning unit.

DESIGN OF THE SULPHUR BURNER

As shown in FIG. No. 13, the burner consists of three pieces. First, a cylindrical piece 54 which has the form of a glass with a hole on the bottom center. This hole has a nipple 55 welded onto it.

A second piece 56 which is the combustion chamber and has the same shape as the first piece but smaller dimensions, diameter and height than same, so that it will fit into the first piece. This piece 56 has a number of holes 57 approximately two thirds from its bottom. On the upper end which is the open end, there is a flange with circular shape 58 and with a guide and a seat 59 with which the first piece 54 can be sealed completely if it is superimposed within it.

Placed in this way, there is a free space 60 between both pieces 54 and 56 due to the difference in size. The holes 57 communicate the insides of these two pieces 54 and 56. Last, there is a third piece 61 which has the shape of a disc and which serves as a lid for piece 56, which it can seal completely.

This lid 61 has a number of holes on which pipes of small diameter 62 are inserted, said pipes being long enough to have their lower ends close to the bottom of piece 56 when same is sealed by piece 61.

The burner operates in the following manner: The first two pieces 54 and 56 are placed mutually superimposed.

Sulfur is placed on the bottom 63 of the second piece 56, fire is put on it and lid 61 is put on its place at the same time an air draft is let in through pipes 62. This air feeds the combustion of sulfur and the gases from this combustion have no other way out except holes 57, through which they move on to piece 54 and exit through its bottom through nipple 55. If this burner is connected to respiration pipe 28 of tanning tank 1, screwing its nipple 55 onto valve 29 of this pipe, same can be actuated as previously mentioned with the air draft that is formed towards the inside of tank 1 when the purging bath is let out. In this way, sulfur dioxide is obtained easily and economically and the entrance of oxygen into the tank is prevented.

Figure 9:
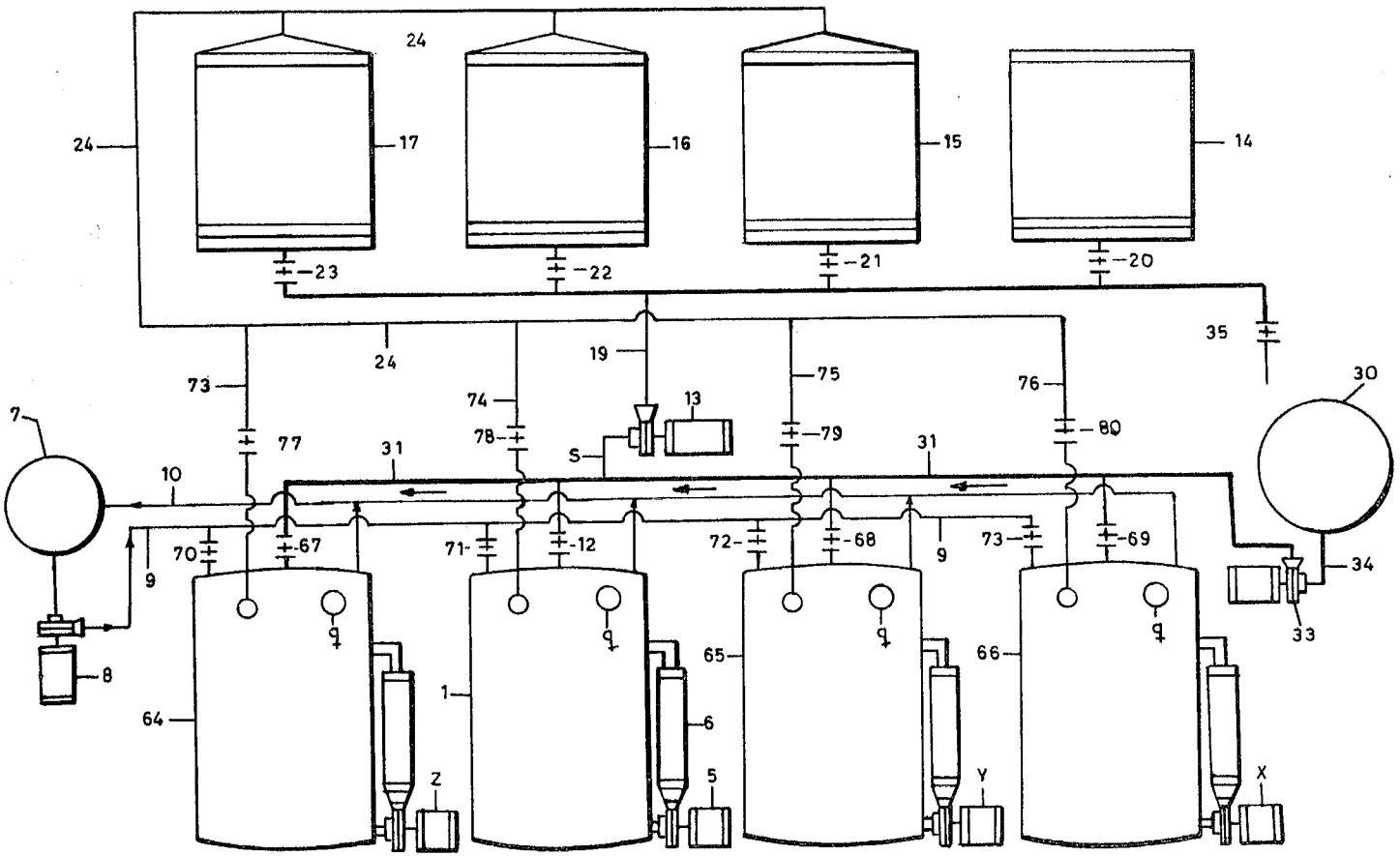
FIG. 9 is a partial plan view and a partial elevational view of an apparatus for continuous production of tanning skins according to another embodiment of the present invention.

TANNING UNIT ADAPTED FOR CONTINUOUS PRODUCTION:

With a cost that is relatively low, a unit such as the one described can be adapted for continuous production. The only thing that is required is an increase in the number of tanning tanks. The rest of the installation remains unchanged, as shall hereinafter be seen. In FIG. No. 9 a unit of this type is shown. In order to show on same all its parts and the way they are connected, in this FIG. 9 part of the installation is drawn in plan drawing and the other part is presented in elevation. In the plan drawing we see four tanning tanks 64, 1, 65 and 66 with their respective lower output valves 67, 12, 68 and 69.

Also in the plan drawing water heater 7 and its pump 8, dissolution tank 30 for the reinforcement of liquors and its pump 33 can be seen.

In elevation we can see the four elevated storage tanks 14, 15, 16 and 17 with their respective lower output valves 20, 21, 22 and 23 and a lower pipeline 18 that interconnects them.

The contents of each of the elevated tanks is as follows:

No. 14 for the purging bath

No. 15 for liquor No. 1 (weak), for example 4° Be.

No. 16 for liquor No. 2 (medium density), for example 8° Be.

No. 17 for liquor No. 3 (high density), for example 12°-14° Be.

No. 14 is opened on its upper portion and the other three are tightly sealed.

The same water heater 7 with its pump 8 for circulation serves the four tanning tanks: its pipeline that goes from the heater to the tanning tanks connects with the entrances of the coil of each of said tanks. Each one of these entrances has its corresponding flow control valve under numbers 70, 71, 72 and 73, in that same order. The outogoing pipeline for water that comes from these coils connects with pipeline 10 for the return of water to the heater.

Connected in thia way, the water heater serves the four tanning tanks: for example, the content of tank 64 would be heated by opening only its valve 70. If the content of tank 65 is the one to be heated, only valve 72 is opened, etc.

In a similar way, the same dissolution tank 30 for tanning extracts serves to reinforce the liquors of all the tanning tanks: it should be noted that the four lower output pipelines of the four tanning tanks are connected to a main pipeline 31 which is the same that goes to dissolution tank 30. Thus, if for example it is desired to reinforce the liquor of tank 64, its valve 67 and valve 32 of the dissolution tank shall be opened up. The liquor comes out and by gravity moves into tank 30 filling it up. If the liquor to be reinforced is that of tank 65, its valve 68 and valve 32 are opened up, etc. ; with the aid of pump 33 these liquids return to their original tank.

Pipeline 31, which is the main one, is common to the four tanning tanks and connects, through line S, with the suction of the elevation pump 13. Lower line 18, which is common to the four elevated tanks, connects through line 19 with the discharge of the same pump 13.

This allows any of the liquids contained in any of the tanks to come down by gravity and to fill up any of the tanning tanks; for example, the liquid contained in elevated tank 14 can come down to tank 64 by opening valve 67, to tank 65 by opening its valve 68; or the liquid contained in elevated tank 17 can come down by opening its valve 23 and fill up tank 66 when its valve 69 is opened up, or fill up tank 1 when its valve 12 is opened up.

The passage of liquids is through pump 13, and with this same pump these liquids can go back to their original tanks through the same route. Each of the elevated titghtly sealed tanks 15, 16 and 17 has on its uppermost part an output nipple. A pipeline 24 interconnects them and connects them with the four tanning tanks, also on the uppermost part thereof, by means of lines or branches 73, 74, 75 and 76 which correspond to tanks 64, 1, 65 and 66, respectively, and each of which has a valve numbered 77, 78, 79 and 80, in the same order. Thus, it is possible to communicate the inside of the three elevated tanks 15, 16 and 17, which are tighltly sealed, with the inside of any of the four tanning tanks 64, 1, 65 and 66. This intercommunication is between the upper part of the elevated tanks with the upper part of the tanning tanks. Thus, for example, when valve 77 is opened up, the inside of tanks placed above is communicated with the inside of tank 64, and when valve 80 is opened up, the inside of the elevated tanks is communicated with the inside of tank 66, etc.

Furthermore, each of the tanning tanks has its own stirring system, coil and a burner "q" for sulfur, such as the one previously described.

It should be kept in mind that this burner is only used once with each batch of skins, and such step takes place when the purging bath is let out upon completion of said operation.

OPERATION OF THE TANNING UNIT ADAPTED FOR CONTINUOUS PRODUCTION

In order to explain the operation of the tanning unit for continuous work we use the same FIG. No. 9.

Let us assume that the liquors are already prepared and located in their respective tank:

Elevated tank No. 15 with liquor No. 1.

Elevated tank No. 16 with liquor No. 2.

Elevated tank No. 17 with liquor No. 3.

Elevated tank NO. 14 with the solution to take lime off.

FIRST WORKING DAY

We load with skins from lot No. 1 in tripe form, without meat but alkaline, the first tanning tank No. 64. The loading door is closed and the liquid to take lime off is sent down opening valves 20 and 67 and that of the sulfur burner "q" of this tank 64, which in the drawing is not shown because the tank is drawn up in plan view. This burner serves as respiration pipe in this case, since upon entrance of the liquid to take lime off into tank 64, displaced air comes out through said pipe, that is, through the burner, as previously explained. Valves 20 and 67 are closed up.

In case it is necessary, the purging bath is heated, for which purpose heater 7 and its pump for recirculation 8 are actuated, and valve 70 is opened up. The strirring system of tank 64 is left working almost uninterruptedly until next day.

SECOND DAY

Batch No. 2 of skins is loaded into tank No. 1 and the loading door is closed up.

By then, the skins of tank 64 should be without lime and duly softened. The sulfur burner of this tank is prepared and lighted up at the same time that the purging bath is let out through pump 13, for which valves 20 and 67 are opened up. When displacement of the bath is completed, tank 64 is filled up with the sulfur combustion gases, purging bath remains in its tank No. 14 and valve 20 is closed up.

This purging bath can be let out down the drain by opening valve 35, and a new one is prepared, or else it may be reinforced and used again. In any of these cases, it is let down now into tank 1, for which valves 20 and 12 and that of the sulfur burner of this tank 1 are opened, the latter in order to let the air of tank 1 come out.

In case of need, the purging bath is heated lighting up heater 7 and actuating its pump 8 as long as is necessary.

The stirring system of tank 1 is left working as usual.

Tanning of batch 1 is started in tank 64 when valves 21 and 67 are opened up so that liquor No. 1 can come down, at the same time that valve 77 which communicates with the elevated tanks is opened up, and valve of burner of tank 64 is dosed up. The result of this is that the gaseous content produced by sulfur combustion of this tank 64 goes up into elevated tank 15.

Liquor is let in only in enough quantity to cover the skins. If so desired, liquor No. 1 is heated actuating heater 7 and its pump 8. The stirring system is left to work until next day.

At the end of this day's journey we have:

Tank No. 64 with batch of skins No. 1 and liquor No. 1.

Tank No. 1 with batch of skins No. 2 and bath to take lime off.

Tank 15 with combustion gases from sulfur.

Third Day

Batch of skins No. 3 is loaded into tank 65 and loading door is closed up. Purging bath is taken up from tank 1 to 14 by actuating the sulfur burner of tank 1 so that same is filled up with combustion gases. The bath to take lime off, which can be a new one or the old one reinforced, is taken down once more, this time to tank 65. If necessary, the bath is heated as usual. The stirring system is left to work in tank 65.

Tanning of the skins in tank 64 is continued now with liquor No. 2. First, liquor No. 1, which fills up tank 64, is taken up to tank 15. Gases in tank 15 go down to tank 64. Liquor No. 2 is taken down to tank 64 opening valves 22 and 67. Gases from tank 64 go up to tank 16.

We start tanning in tank 1 taking down liquor No. 1 from tank 15 to tank 1. Gases from tank 1 go up to tank 15. Liquors in tanks 64 and 1 can be heated as usual, if so desired; the stirring systems in these two tanks are left working until next day.

At the end of this day's work we have:

Tank 65 with batch of skins No. 3 and the purging bath. Tank No. 1 with batch of skins No. 2 and liquor No. 1. Tank 64 with batch of skins No. 1 and liquor No. 2. Elevated tanks 15 and 16 with combustion gases.

Fourth Day

Batch No. 4 of skins is loaded into tank No. 66. The solution to take lime off is taken up from tank 65 to tank 14. Said tank 65 is filled up with gases due to the fact that its sulfur burner has operated.

The liquid to take lime off, either fresh or reinforced, is taken down from tank 14 to tank 66. If necessary, this bath is heated. The stirring system of tank 66 is left to work until next day.

Tanning is started in tank 65 with liquor No. 1: first, it is moved up from tank 1 to tank 15; gases go down from tank 15 to tank 1. Then, it is moved down from tank 15 to tank 65; gases in tank 65 move up to tank 15.

Tanning is continued to tank 1, now with liquor No. 2. First, said liquor is moved up from tank 64 to tank 16. Gases in tank 16 go down to tank 64. Now, said liquor No. 2 is sent down from tank 16 to tank 1. Gases in tank 1 move up to tank 16.

Tanning is continued in tank 64, now with liquor No. 3; said liquor is moved down from tank 17 to tank 64, opening valves 23 and 67. Combustion gases move up from tank 64 to tank 17.

Stirring systems of tanks 64, 1 and 65 are left working until next day. If necessary, these liquors shall be heated as usual.

At the end of this day's work we shall have:

Tank 66 with batch of skins No. 4 and the purging bath.

Tank 65 with batch of skins No. 3 and liquor No. 1.

Tank 1 with batch of skins No. 2 and liquor No. 2.

Tank 64 with batch of skins No. 1 and liquor No. 3.

Elevated tanks 15, 16 and 17 remain filled up with sulfur combustion gases.

Fifth Day

By then, batch of skins No. 1 of tank 64 should be well tanned.

Liquor No. 3 contained therein is let out and sent to its tank No. 17. Gases in this tank go down to tank 64. Skins are let to drain inside the tank as long as necessary for them to stop dripping.

Drippings are extracted through the purging cock P.

DEPHLEGMATION

Liquor No. 1, which is in tank 65, may be used as washing liquid. Liquor is first moved up to tank 15. Gases contained in tank 15 are taken down to tank 65.

This liquor No. 1 is then moved down to tank 64 and the gases in tank 64 are moved to tank 15.

With the stirring system, tanned skins are washed up as required. Thereafter, the washing liquid is sent back to its tank No. 15. Tank 64 remains with the sulfur gases.

Within the same tank 64, skins are left to drain off as desired or as long as dripping continues. Drippings are extracted through purging cock P, and skins are unloaded. Tank 64 and its pipelines are washed up with water and the tank is loaded again with batch No. 5 of skins.

The "work chain" is hereinafter established. The unit delivers every day a batch of tanned skins and a new batch goes into the process.

DISSOLUTION TANK

The liquors used in tanning must be "reinforced" daily between each batch of skins, in order to maintain the density they should have.

For this operation, the unit has the so-called dissolution tank 30 (See FIG. No. 1).

This tank has a cylindrical shape, but has the form of a cone on its lower end. Its capacity can be between 25 and 30% that of tanning tanks.

It has two sections A and B which are placed one on top of the other. FIG. 10 shows section A in a vertical projection of a longitudinal section.

Said section A has inside it the mixing equipment formed by a motor 82, shaft 83 and propeller 84, and a helicoidal piece 85; also inside it is the deposit 86 for the tanning powder to be dissolved.

Motor 82 is placed vertically with respect to its shaft, in the center of the deposit, and it is held in place by a cross piece 87 the ends of which are fixed to the deposit walls.

Powder deposit 86 is a receptacle which has the shape of a truncated cone, with its smaller base 88 projected down in a cylindrical shape.

On the upper side portion of this section A is hopper 89 for loading powder.

In lower section B of the dissolution tank we observe (FIG. 11) also a vertical projection of a longitudinal section in a plan view, which shows the dissolution tank as such, that is, the deposit for the liquid that is to be reinforced. This tank is also cylindrical, but with the form of a cone on its lower end. Through this lower end, the liquids to be reinforced go in and out of the deposit.

The upper portion of this section B is closed, but bears a circular opening 90 in its center. On its upper side portion, there is an output pipe, with a valve 91, which is connected by means of a hose to a receptacle that contains some gas such as $SO_2$ or nitrogen.

The two sections A and B are placed one on top of the other as shown in FIG. No. 12 and are screwd up with flange 81.

When they are placed in this way, propeller 84 of motor 82 and the lower portion of the powder deposit 86 of section A go in through the circular openeing 90 of section B, remaining inside it and closing it up.

Helicoidal piece 85 is located at the bottom of the powder deposit and serves as a gate therefor.

OPERATION OF THE DISSOLUTION TANK

This tank operates in the following manner: valve 32 is opened (See FIG. No. 12), as well as that of the tanning tank in which we want to reinforce the liquor; liquid is allowed to go in until the deposit is completely filled up, that is, section B or lower section thereof; with this, we make sure that air is expelled completely. Valve 32 is closed up and deposit 86 is loaded with tanning powder.

A small amount of liquid is let out through pump 33, taking care only that propeller 84 is covered; at the same time, valve 91 is opened up to let in $SO_2$ gas, which shall occupy the space of the displaced liquid. With same, entrance of air is prevented and dissolution without air is assured.

Motor 82 is started up. Helicoidal piece 85 introduces powder into the liquid deposit, said power falling on top of the propeller to be dissolved by it. After dissolving the amount of powder that is to be added, motor 82 is stopped, and opening up valve 32, with pump 33 liquid is sent back, with the powder incorporated into it, to the tank where it came from.

Figure 14:
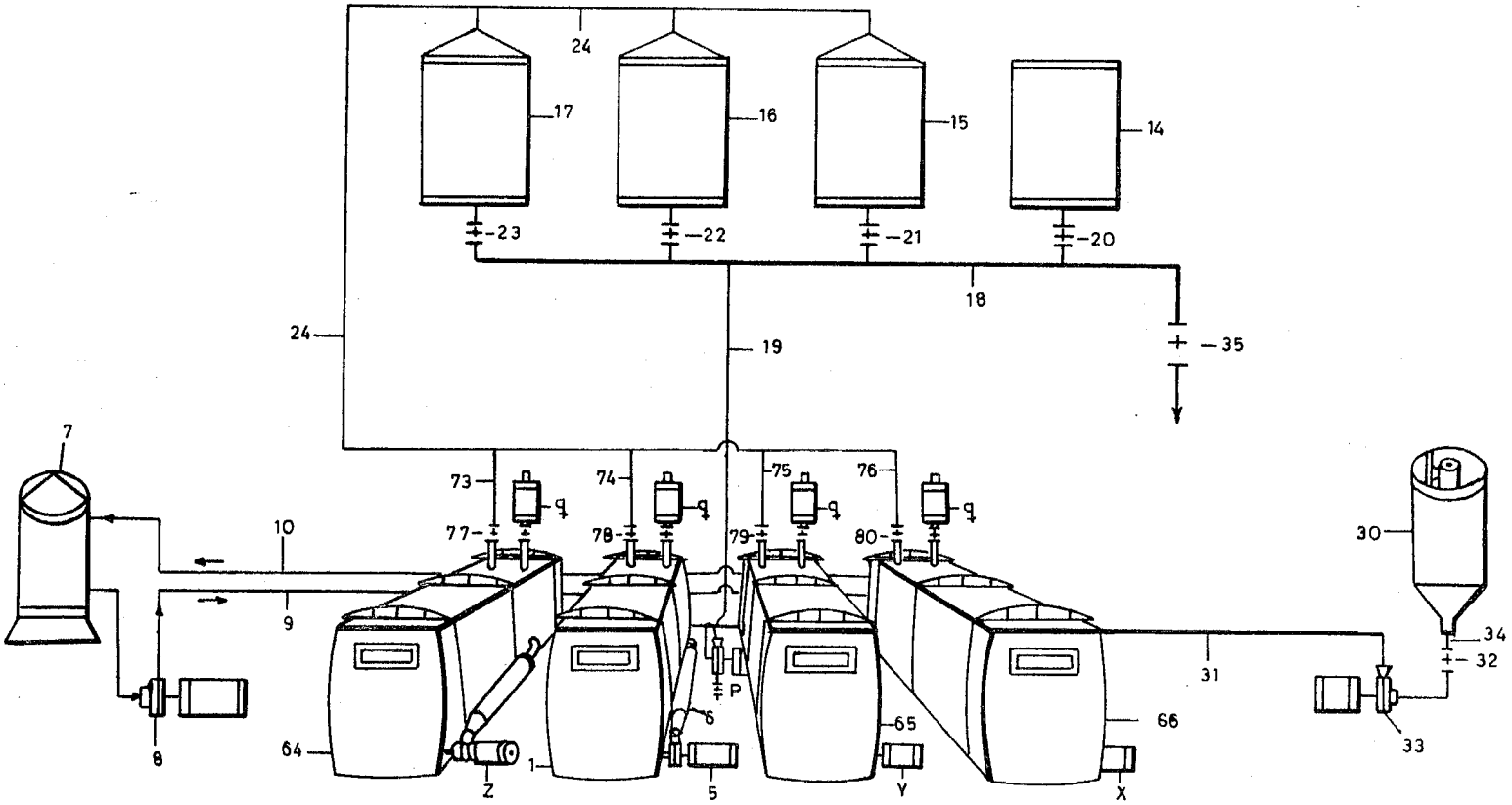
FIG. 14 is a perspective graphic illustration of the apparatus for continuous production of tanning skins.
Figure 15:
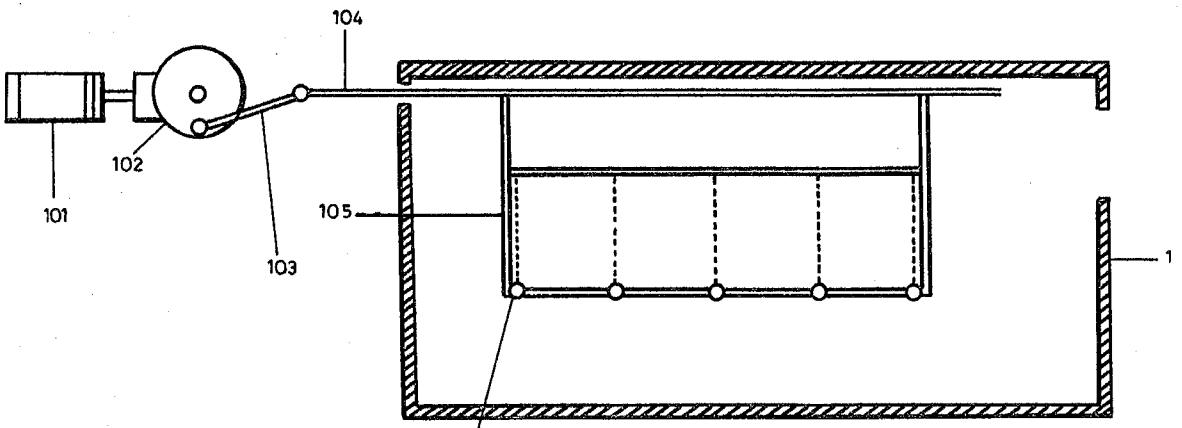
FIG. 15 is a side elevational view in longitudinal section illustrating the mechanism for moving the skins in the tanning tank.
Figure 17:
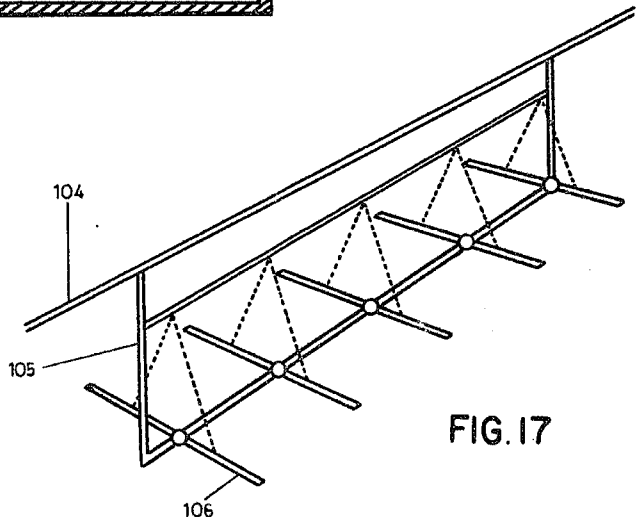
FIG. 17 is an elevational view in longitudinal section of the tanning tank with skins mounted therein.

FIG. 14 is a composite view, drawn in conventional perspective, of a tanning unit for continuous production, formed by four tanning tanks and four elevated tanks for the storage of liquids, and all the other fittings and connections that consitutes said unit. This drawing requires no additional explanation, since all its parts have already been referred to in the previous explanation and everything is well known and perfectly identifiable.

In FIG. Nos. 9 and 14, recirculating pumps of the corresponding stirring systems are indicated as Z, 5, Y and X.

I claim:

1. An apparatus for tanning skins in a rapid and efficient manner comprising a closed first tanning tank where skins to be tanned are hung, said first tanning tank having at least one airtight door for loading and unloading the skins, an inlet/outlet pipe with a valve for filling and emptying said first tanning tank, and an elevation pump operatively connected thereto, and a respiration pipe to permit gas to enter and exit said first tanning tank;

said respiration pipe having means for producing a gas which is chemically inert to tanning liquids;

first, second and third storage tanks for storing different liquids used in tanning, said first storage tank being open on its upper portion, said second and third storage tanks being airtight;

each of said first, second and third storage tanks having an output pipe with a valve for controlling the flow of liquid therethrough, said output pipes being connected to said elevation pump through a pipe system;

said second and third storage tanks and said first tanning tank having outgoing pipes, said outgoing pipes of said second and third storage tanks being connected to said outgoing pipe of said first tanning tank to permit gases to flow between each of said second and third storage tanks and said first tanning tank.

2. An apparatus according to claim 1, wherein said first tanning tank has steel belts coupled thereto for preventing deformation of and for hanging skins in said first tanning tank.

3. An apparatus according to claim 1, wherein said first tanning tank includes an internal stirring system.

4. An apparatus according to claim 3, wherein said internal stirring system comprises a recirculating pump for extracting and reinjecting liquids into and out of said first tanning tank and a filter for cleaning the liquids.

5. An apparatus according to claim 3, wherein said internal stirring system comprises means for moving the skins in said first tanning tank during treatment thereof.

6. An apparatus according to claim 5, wherein said skin moving means comprises a motor mounted outside said first tanning tank;

an eccentric member coupled to said motor to be rotated thereby;

a connecting rod coupled at one end thereof to said eccentric member at a point spaced from the axis of rotation of said eccentric member; and a skin hanging frame connected to the other end of said connecting rod and movably mounted in said first tanning tank.

7. An apparatus according to claim 6, wherein said skin hanging frame has a plurality of retracting cross pieces from which skins are hung vertically, whereby the skins are moved in a pendular manner upon actuation of said skin moving means.

8. An apparatus according to claim 1, wherein said first tanning tank has an internal heating system to heat the liquids therein during treatment of the skins.

9. An apparatus according to claim 8, wherein said heating system employs steam.

10. An apparatus according to claim 8, wherein said heating system employs hot water.

11. An apparatus according to claim 1, wherein said elevation pump is located below the bottom of said first tanning tank with the suction of said elevation pump adjacent said first tanning tank inlet/outlet pipe valve.

12. An apparatus according to claim 1, wherein said gas producing means comprises a sulfur burner for producing sulfur dioxide.

13. An apparatus according to claim 12, wherein said sulphur burner comprises a first cylindrical member having a bottom with an opening therein, and a nipple fixedly connected to said opening;

a second cylindrical member forming a combustion chamber, being of smaller diameter than and mounted within said first cylindrical member, and having a closed bottom; said second cylindrical member having a plurality of apertures therein spaced from the bottom thereof approximately two-thirds of the length of said second cylindrical member; and a third member forming a lid to close said second cylindrical member; said lid being circular and having several holes therein in which air pipes are located for admitting air into said sulphur burner; said air pipes extending into said second cylindrical member to a point between said aperture and said second cylindrical member bottom.

14. An apparatus according to claim 1, wherein said first storage tank contains a solution for taking lime off the skins, said second storage tank contains a relatively weak tanning liquid to begin tanning and said third storage tank contains a relatively strong tanning liquid to finish the tanning.

15. An apparatus according to claim 1, wherein said first, second and third storage tanks are located above said first tanning tank; said outgoing pipes are connected to the upper portions of said second and third storage tanks and said first tanning tank; and said output pipes are connected to the lower portions of said first, second and third storage tanks.

16. An apparatus according to claim 1, wherein a dissolution tank for preparing and reinforcing tanning liquids is connected through a pipeline to said first tanning tank.

17. An apparatus according to claim 16, wherein said dissolution tank and said first tanning tank are located on the same level and said pipeline is coupled to the lower portions thereof; said pipeline includes a pump and a valve to control flow therethrough.

18. An apparatus according to claim 16, wherein said dissolution tank comprises a vertical upper body having a cone-shaped lower end, stirring means and a hopper located adjacent the upper end of said upper body;

a lower body coupled to the lower end of said upper body; said lower body having a truncated cone-shaped lower end with an outlet pipe at the apex thereof connected through a valve to said pipeline and having a closed upper end with a central opening through which part of said stirring means extends; a gas pipe is connected to said lower body adjacent said closed upper end for supplying therein a gas which is chemically inert to tanning liquids.

19. An apparatus according to claim 1, wherein an airtight fourth storage tank is provided adjacent said second and third storage tanks, said fourth storage tank has an output pipe with a valve for controlling the flow of liquid therethrough and an outgoing pipe connected to said outgoing pipe of said first tanning tank to permit gas to flow therebetween; said fourth storage tank output pipe is connected to said elevation pump; and said first storage tank contains a purging solution, said second storage tank contains a tanning liquid of relatively low density, said third storage tank contains a tanning liquid of medium density, and said fourth storage tank contains a tanning liquid of relatively high density.

20. An apparatus according to claim 1, wherein closed second and third tanning tanks are provided adjacent said first tanning tank; said second and third tanning tanks each having at least one airtight door for loading and unloading the skins, an inlet/outlet pipe with a valve for filling and emptying said second and third tanning tanks, a respiration pipe to permit gas to enter and exit said second and third tanning tanks with means for producing a gas chemically inert to tanning liquids; and an outgoing pipe connected to said outgoing pipes of said second and third storage tanks to permit gas to flow therebetween;

said inlet/outlet pipes of said second and third tanning tanks are connected to said elevation pump;

whereby the apparatus may continuously tan skins and the liquids in said first, second and third storage tanks may each flow into each of said tanning tanks through the same elevation pump.

21. An apparatus according to claim 19, wherein a single dissolution tank for preparing and reinforcing tanning liquids is connected through a pipeline to each of said tanning tanks.

22. An apparatus according to claim 20, wherein said storage tanks are located aboved said tanning tanks.

23. An apparatus according to claim 20, wherein a single heating means is provided for heating a fluid and conduit means connects each of said tanning tanks to said heating means for selectively conveying heated fluid to each tanning tank to heat same.

24. An apparatus according to claim 20, wherein an airtight fourth storage tank is provided adjacent said second and third storage tanks, said fourth storage tank has an output pipe with a valve for controlling the flow of liquid therethrough and an outgoing pipe connected to said outgoing pipes of said tanning tanks to permit gas to flow therebetween; said output pipe is connected to said elevation pump; and said first storage tank contains a purging solution, said second storage tank contains a tanning liquid of relatively low density, said third storage tank contains a tanning liquid of medium density, and said fourth storage tank contains a tanning liquid of relatively high density.

25. An apparatus according to claim 1, wherein said first tanning tank is formed from a material selected from the group consisting of fiberglass and stainless steel.

26. An apparatus according to claim 1, wherein said first tanning tank is generally in the shape of a parallelepiped with an elongated rectangular cross section, flat roof and slightly bulged side walls and bottom;

a plurality of steel belts are provided on the outside of said first tanning tank, the upper portion of said belts being arch-shaped;

skin hanging means mounted inside said first tanning tank for suspending skins from the roof of said first tanning tank comprising a rail suspended from said belts by a framework, said rail extending along the length of said first tanning tank; and hangers for suspending skins from said rail.

* * * * *